US011053804B2

(12) United States Patent
Moradi et al.

(10) Patent No.: US 11,053,804 B2
(45) Date of Patent: Jul. 6, 2021

(54) SHROUD INTERLOCK

(71) Applicant: PRATT & WHITNEY CANADA CORP., Longueuil (CA)

(72) Inventors: Niloofar Moradi, Cote Saint Luc (CA); John Pietrobon, Outremont (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 16/406,435

(22) Filed: May 8, 2019

(65) Prior Publication Data

US 2020/0355081 A1 Nov. 12, 2020

(51) Int. Cl.

| | |
|---|---|
| ***F01D 5/20*** | (2006.01) |
| ***F01D 5/22*** | (2006.01) |
| *F01D 5/18* | (2006.01) |
| *F01D 5/14* | (2006.01) |

(52) U.S. Cl.

CPC ..... *F01D 5/20* (2013.01); *F01D 5/225* (2013.01); *F01D 5/147* (2013.01); *F01D 5/186* (2013.01); *F05D 2240/307* (2013.01); *F05D 2240/35* (2013.01); *F05D 2240/55* (2013.01); *F05D 2240/80* (2013.01); *F05D 2250/712* (2013.01); *F05D 2260/202* (2013.01); *F05D 2260/22141* (2013.01)

(58) Field of Classification Search

CPC ..... F01D 5/20; F01D 5/225

See application file for complete search history.

(56) References Cited

U.S. PATENT DOCUMENTS

| | | | | |
|---|---|---|---|---|
| 7,001,152 | B2 * | 2/2006 | Paquet | F01D 5/225 29/889.21 |
| 7,066,714 | B2 * | 6/2006 | Miller | F01D 5/225 415/173.6 |
| 7,527,477 | B2 * | 5/2009 | Norton | F01D 5/225 29/889.2 |
| 9,103,218 | B2 * | 8/2015 | Pikul | F01D 5/225 |
| 9,303,516 | B2 | 4/2016 | Collin et al. | |
| 10,190,423 | B2 | 1/2019 | Plante et al. | |
| 10,641,108 | B2 * | 5/2020 | Bergman | F01D 5/147 |

* cited by examiner

*Primary Examiner* — Justin D Seabe

(74) *Attorney, Agent, or Firm* — Norton Rose Fulbright Canada LLP

(57) ABSTRACT

A shroud for a turbine blade includes a shroud body having an outer side and opposite first and second Z-shaped side edges; a first sealing fin and a second sealing fin extending outwardly from the outer side and spaced apart from each other in a streamwise direction, the first and second sealing fins extending between the first and second side edges of the shroud body; a first ridge extending radially outwardly from the outer side, the first ridge extending from and connecting the first and second sealing fins along the first side edge and having a radial height which varies; and a second ridge extending radially outwardly from the outer side, the second ridge extending from and connecting the first and second sealing fins along the second side edge and having a radial height which varies.

19 Claims, 5 Drawing Sheets

SHROUD INTERLOCK

FIELD

This relates to turbines for gas turbine engines, and more particularly, to shrouded turbine blades.

BACKGROUND

Turbine rotors comprise circumferentially-disposed turbine blades extending radially from a common annular hub. Each turbine blade has a root portion connected to the hub and an airfoil shaped portion projecting radially outwardly into the gas path. The turbine blades may have shrouds at the tips of the blades opposite to the roots.

Shrouds are material extending from the tips of the blades. The shrouds extend in a plane generally perpendicular to that of the airfoil portion. Shrouds reduce tip leakage loss of the airfoil portion of the blade. However, the addition of the shroud increases the centrifugal load which causes higher stresses in the airfoil. In addition, the tangential extension of the airfoil generates a bending stress at the intersection between the airfoil and the shroud.

SUMMARY

According to an aspect, there is provided a turbine blade for a turbine engine, the turbine blade comprising: an airfoil extending radially between a blade root and a blade tip; and a shroud provided at a tip of the airfoil, the shroud including: a shroud body having a radially outer side radially opposite the airfoil, the body having opposite first and second Z-shaped side edges; a first sealing fin and a second sealing fin, the first and second sealing fins extending radially outwardly from the outer side of the shroud body and spaced apart from each other in a streamwise direction relative to a direction of flow of combustion gases through the turbine engine in use, the first and second sealing fins extending between the first and second side edges of the shroud body; a first ridge extending radially outwardly from the outer side of the shroud body, the first ridge extending from and connecting the first sealing fin and the second sealing fin along the first side edge, the first ridge having a radial height which varies along the first ridge; and a second ridge extending radially outwardly from the outer side of the shroud body, the second ridge extending from and connecting the first sealing fin and the second sealing fin along the second side edge, the second ridge having a radial height which varies along the second ridge.

In some embodiments, the radial height of the first ridge varies along a width between the first sealing fin and the second sealing fin.

In some embodiments, the radial height of the second ridge varies along a width between the first sealing fin and the second sealing fin.

In some embodiments, a depth of the first ridge tangential to the outer side varies along a width between the first sealing fin and the second sealing fin.

In some embodiments, a depth of the second ridge tangential to the outer side varies along a width between the first sealing fin and the second sealing fin.

In some embodiments, the first ridge follows the first side edge.

In some embodiments, the second ridge follows the second side edge.

In some embodiments, the first ridge and the second ridge are translationally symmetrical.

In some embodiments, the first ridge differs in shape from the second ridge.

In some embodiments, a maximum radial height of the first ridge differs from a maximum radial height of the second ridge.

In some embodiments, the first ridge and the first side edge define a first contact face for abutment with a first counterpart contact face of a first adjacent turbine blade.

In some embodiments, the second ridge and the second side edge define a second contact face for abutment with a second counterpart contact face of a second adjacent turbine blade.

According to another aspect, there is provided a shroud for a rotor blade, the shroud comprising: a shroud body having an outer side and opposite first and second Z-shaped side edges; a first sealing fin and a second sealing fin extending radially outwardly from the outer side and being spaced apart from each other in a streamwise direction relative to a direction of flow of combustion gases through the rotor blade in use, the first and second sealing fins extending between the first and second side edges of the shroud body; a first ridge extending radially outwardly from the outer side of the shroud body, the first ridge extending from and connecting the first sealing fin and the second sealing fin along the first side edge, the first ridge having a radial height which varies along the first ridge; and a second ridge extending radially outwardly from the outer side of the shroud body, the second ridge extending from and connecting the first sealing fin and the second sealing fin along the second side edge, the second ridge having a radial height which varies along the second ridge.

In some embodiments, the radial height of the first ridge varies along a width between the first sealing fin and the second sealing fin and the radial height of the second ridge varies along a width between the first sealing fin and the second sealing fin.

In some embodiments, a depth of the first ridge tangential to the outer side varies along a width between the first sealing fin and the second sealing fin and a depth of the second ridge tangential to the outer side varies along a width between the first sealing fin and the second sealing fin.

In some embodiments, the first ridge follows the first side edge.

In some embodiments, the second ridge follows the second side edge.

In some embodiments, the first ridge and the second ridge are translationally symmetrical.

In some embodiments, the first ridge differs in shape from the second ridge.

In some embodiments, a maximum radial height of the first ridge differs from a maximum radial height of the second ridge.

Other features will become apparent from the drawings in conjunction with the following description.

BRIEF DESCRIPTION OF DRAWINGS

In the figures which illustrate example embodiments.

DETAILED DESCRIPTION

Figure 1:
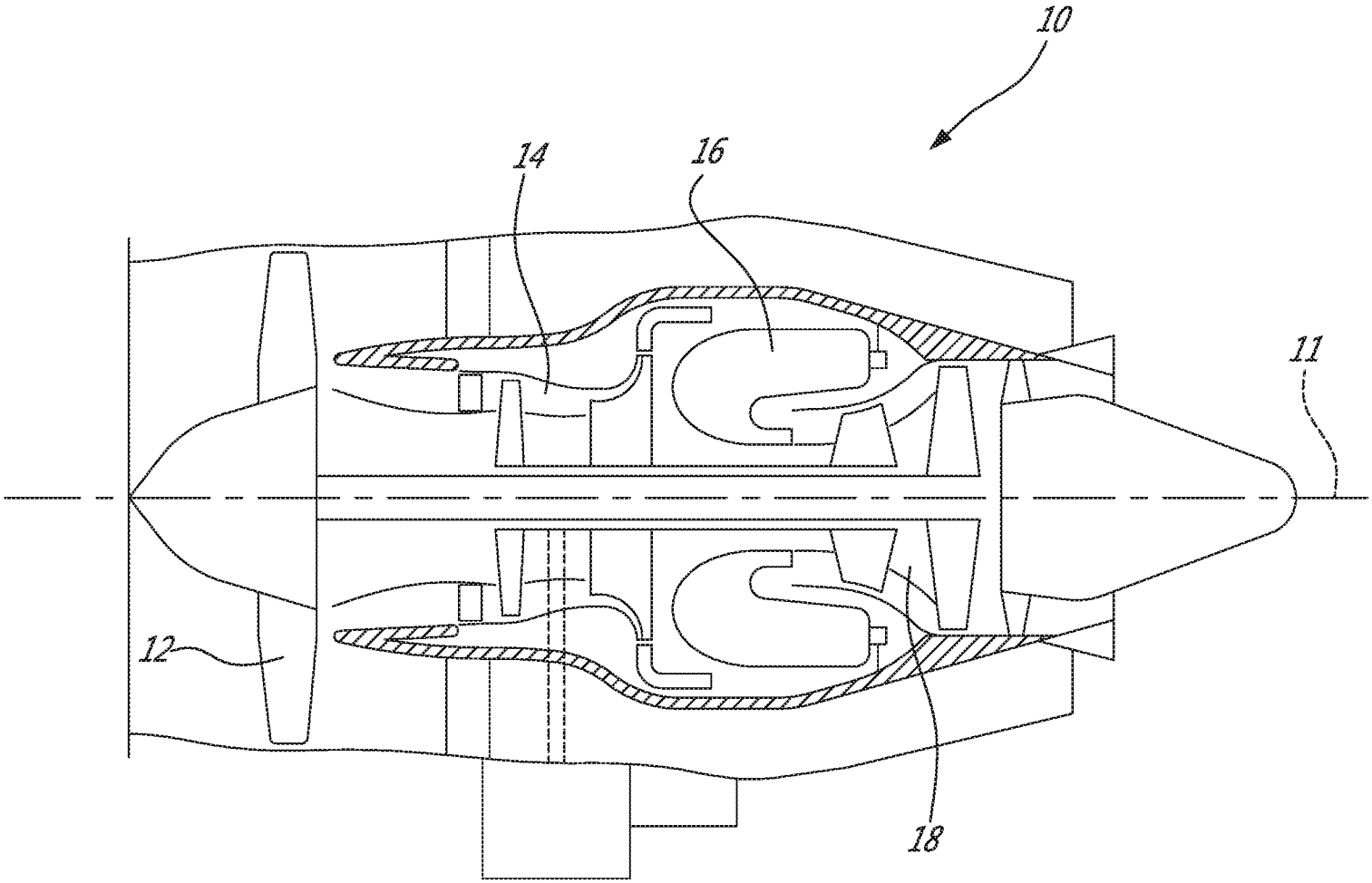
FIG. 1 is a schematic cross-section view of a gas turbine engine.

FIG. 1 illustrates a gas turbine engine 10 of a type provided for use in subsonic flight, generally comprising in serial flow communication along a central axis 11: a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
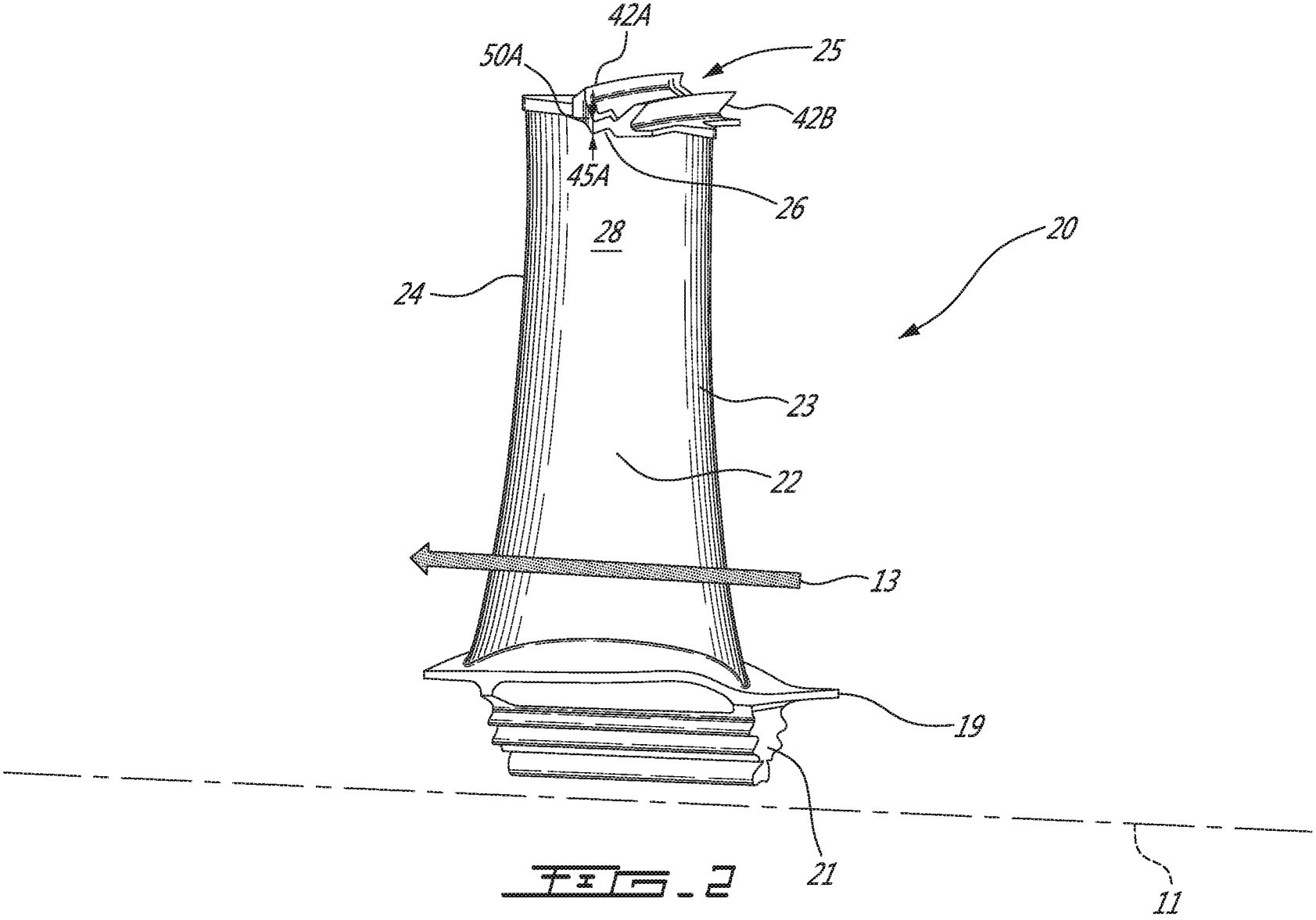
FIG. 2 is a perspective view of a turbine blade of a gas turbine engine such as the one of FIG. 1, according to an embodiment.

Turning now to FIG. 2, turbine section 18 includes at least one, but generally a plurality of turbine rotors (not shown). The turbine rotors each comprise an annular hub (not shown) and a plurality of circumferentially-disposed turbine blades 20 attached thereto. Turbine blades 20 extend radially relative to the longitudinal central axis 11 which additionally defines a central axis of the turbine rotors.

Each turbine blade 20 may have a root 21 depending from a platform 19 and extending radially inwardly from platform 19, an airfoil 22 extending radially outward from platform 19, and a shroud 25 provided at an outer radial end 26 or tip of the airfoil portion 22 opposite root 21. Root 21 of each turbine blade 20 may be received with correspondingly-shaped firtree slots in the annular hub of the turbine rotor. Root 21 shown in FIG. 2 is only one example of root usable with turbine blade 20.

Airfoil 22 of turbine blade 20 may extend into a gas path accommodating the annular stream 13 of hot combustion gases generated by combustor 16, the hot combustion gases may act on airfoil 22 of turbine blades 20 and cause the turbine rotor to rotate. Airfoil 22 of turbine blade 20 may include a leading edge 23 and a trailing edge 24, trailing edge 24 may be positioned further aft longitudinally than leading edge 23. Airfoil 22 of turbine blade 20 may be cambered (i.e., curved camber line). Airfoil 22 may include a pressure side 28 having a generally concave shape, and a suction side 29 located opposite pressure side 28, suction side 29 may have a generally convex shape. In the embodiment shown herein, airfoil 22 may be twisted along its length (i.e., along a radial direction when disposed in turbine 18). It is contemplated that airfoil 22 could not be twisted.

Figure 3A:
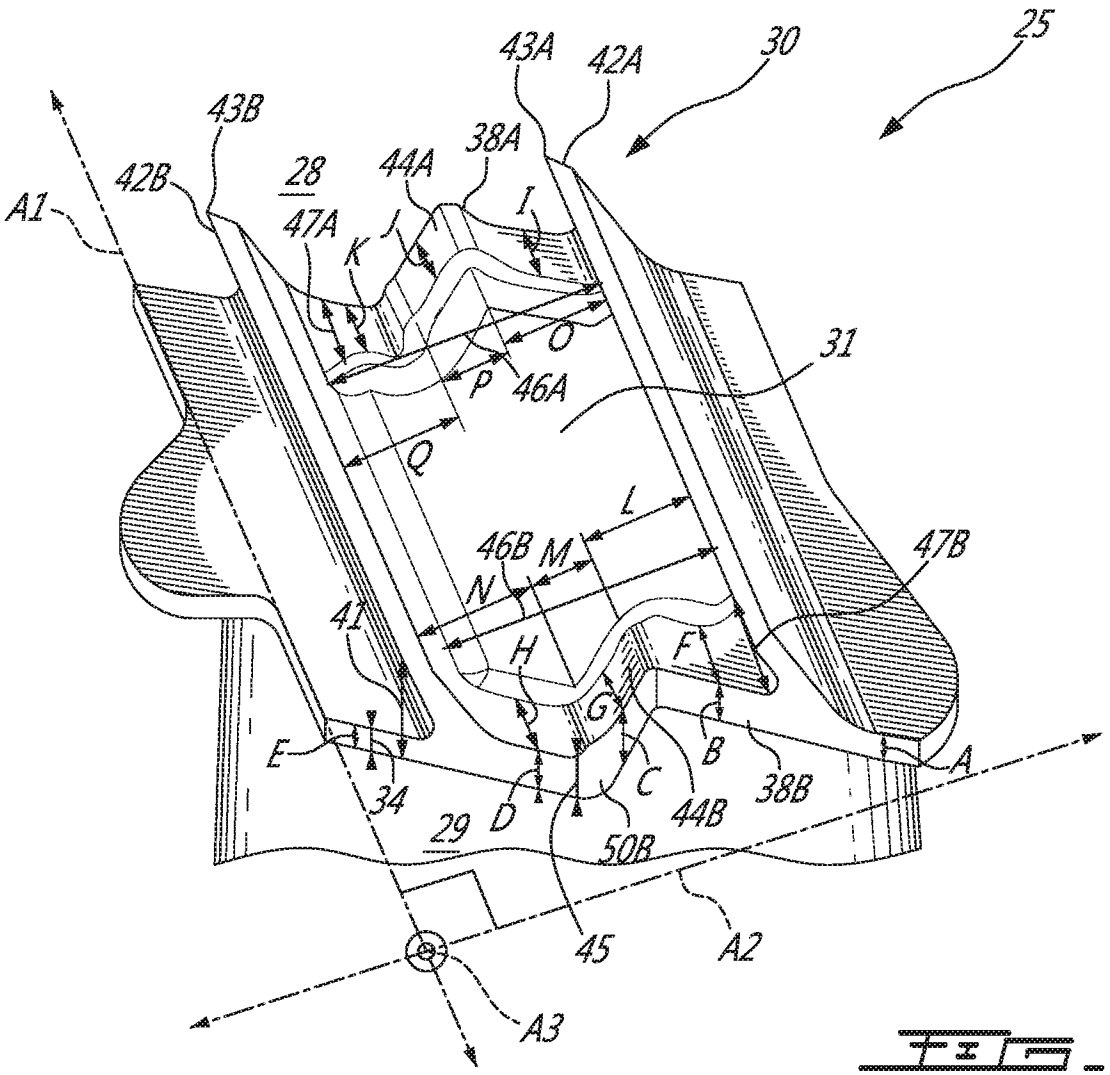
FIG. 3A is a perspective view of a shroud of the blade of FIG. 2.
Figure 3B:
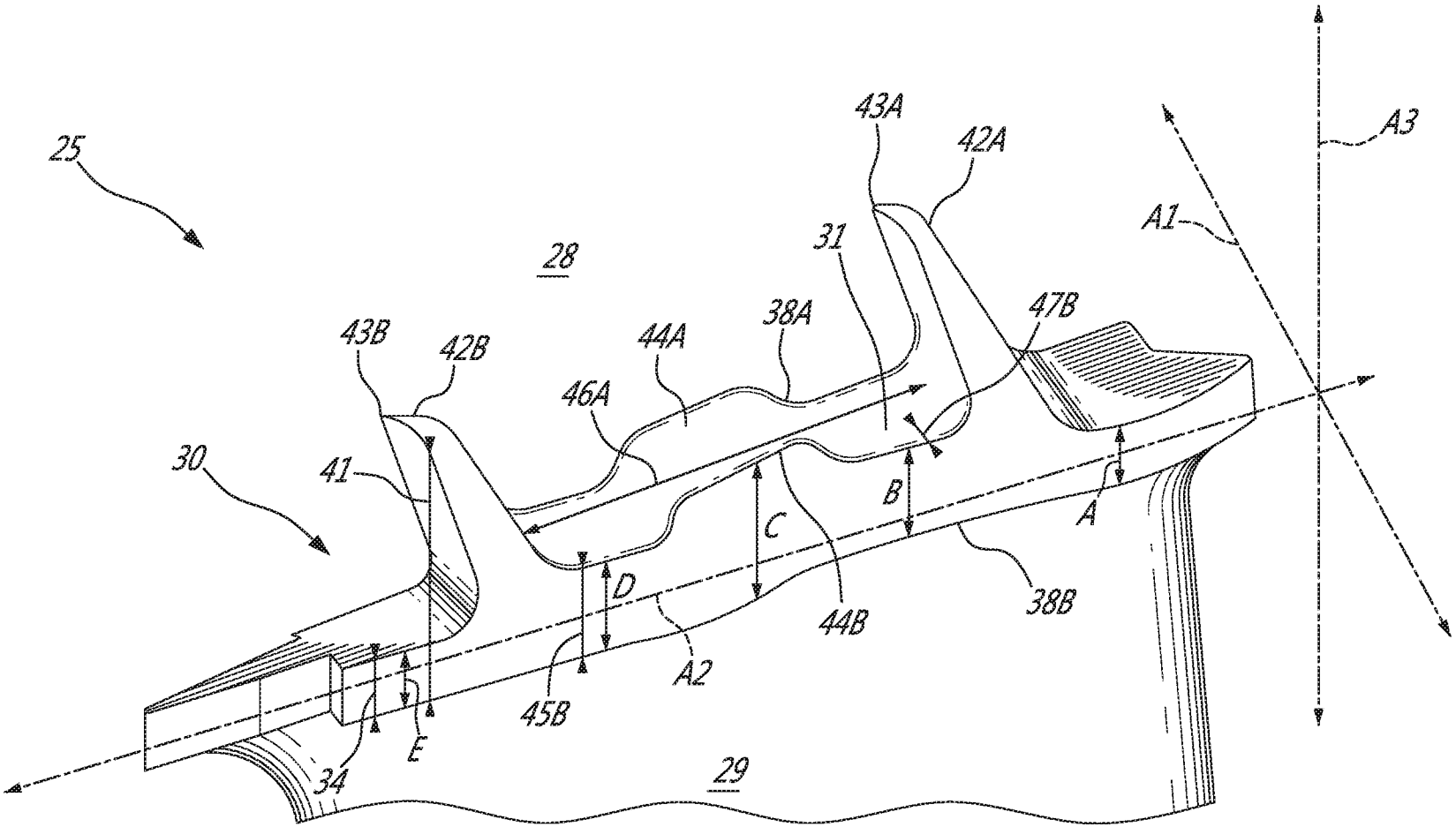
FIG. 3B is another perspective view of the shroud of FIG. 3A.

Turning now to FIGS. 3A, 3B, shroud 25 will now be described. FIG. 3A is a perspective view of shroud 25, and FIG. 3B is another perspective view of shroud 25, with the view further rotated towards the bottom. In some embodiments, shroud 25 is integrally formed with airfoil 22 of turbine blade 20, and covers and extends beyond outer end 26 of airfoil 22.

Shroud 25 may comprise a generally planar prismatic shroud body 30 onto which a local coordinate axis will be defined for the purposes of this description. A first axis A1 may be parallel to central axis 11. A second axis A2 may be orthogonal to the axis A1 and in plane with the body 30. A third axis A3 may be orthogonal to the axes A1 and A2 and may be normal to the body 30. The axis A3 may be in the radial direction relative to central axis 11. It should be understood that shroud 25 may not be exactly planar nor prismatic (i.e. flat), since it is a body of revolution which forms an annulus (or portion thereof) about a center point (e.g. the rotor axis). However for convenience the shroud 25 is described herein as "generally planar".

Shroud body 30 may have a nominal thickness 34 (in the direction of the axis A3). It is contemplated that shroud body 30 could have a locally increased thickness in a portion adjacent airfoil 22 to address bending stresses induced by a radial deflection of shroud 25 the result of the rotation speed.

Shroud body 30 may have a radially outer side 31 radially opposite airfoil 22.

Shroud body 30 may include a pair of opposed side edges, a first side edge 38A and a second side edge 38B, generally oriented along the axis A2.

In some embodiments, one or both of first side edge 38A and second side edge 38B may have a generally Z-shape, namely, the profile of each of first side edge 38A and second side edge 38B may form a Z-shape when viewed from a top view, illustrated by way of example in FIG. 3A.

In other embodiments, first side edge 38A and second side edge 38B may, in top view, have a profile of another shape, for example, resembling an S-shape, a convex shape or a concave shape.

First side edge 38A and second side edge 38B may be of the same shape or different.

Two sealing fins (also sometimes referred as knife edges), namely a first sealing fin (upstream fin 42B) and a second sealing fin (downstream fin 42A), may extend radially outwardly (generally direction A3) and project from outer side 31 of shroud body 30 opposite to the hot gas path. As such, fins 42A, 42B may have a height 41 generally in a direction of the axis A3 larger than nominal thickness 34 of the body 30.

Fins 42A, 42B may extend across shroud body 30 of the shroud 25 from first side edge 38A to second side edge 38B. Fins 42A, 42B may be spaced apart from each other in a streamwise direction, namely, upstream fin 42B upstream of stream 13 and downstream fin 42A downstream of stream 13. In some embodiments, fins 42A, 42B are generally straight and generally parallel to each other and disposed generally along the axis A1.

Fins 42A, 42B may help provide a blade tip seal with the surrounding shroud ring providing stiffening rails which help resist "curling" or centrifugal deflection of the shroud 25.

Fins 42A, 42B may terminate at a point 43A, 43B, respectively, and may be inclined relative to the axis A3 in a direction opposite to a direction 13 of the flow. It is contemplated that the fins 42A, 42B could be vertical instead of being inclined. Inclined fins may be less stiff than vertical fins, which in turn may increase a radial deflection of the fin and stresses at the interface between airfoil 22 and shroud 25 of blade 20. However the inclination of the fins 42A, 42B described herein may allow generation of a secondary flow that acts as an artificial gas wall against the main flow above shroud 25.

A first ridge 44A and a second ridge 44B extend radially outwardly from the outer side 31 of shroud body 30 at first side edge 38A and second side edge 38B, respectively. First ridge 44A and second ridge 44B may join outer face 31, the transition to outer face 31 forming a convex surface, as shown in FIGS. 3A, 3B. Other suitable transitions are contemplated, for example, a concave surface or a straight surface, at an angle between zero and a hundred and eighty degrees.

First ridge 44A and second ridge 44B may extend widthwise between fins 42A, 42B. Each of first ridge 44A and second ridge 44B may extend from and connects fin 42A to fin 42B. First ridge 44A and second ridge 44B may join fins 42A, 42B, and transition to fins 42A, 42B forming a convex surface, as shown in FIG. 3A. Other suitable transitions are contemplated, for example, a concave surface or a straight surface, at an angle between zero and a hundred and eighty degrees.

First ridge 44A may thus run parallel to and follow the shape of first side edge 38A, and second ridge 44B may thus run parallel to and follow the shape of second side edge 38B. In some embodiments, first ridge 44A is flush with first side edge 38A. In some embodiments, second ridge 44B is flush with second side edge 38B.

First ridge 44A and second ridge 44B may each be defined by dimensions (or lengths) of height in direction A3 generally radial from outer side 31, width in direction A2 generally tangential to outer side 31 and depth in direction A1 generally tangential to outer side 31.

First ridge 44A and second ridge 44B may have a first ridge height 45A and a second ridge height 45B, respectively, in a direction of the axis A3.

First ridge 44A and second ridge 44B may have a first ridge width 46A and a second ridge width 46B, respectively, in a direction of the axis A2.

First ridge 44A and second ridge 44B may have a first ridge depth 47A and a second ridge depth 47B, respectively, in a direction of the axis A1.

As described in further detail below, the height, width, and depth of first ridge 44A and second ridge 44B may be non-uniform.

Each of height, width, and depth dimensions of first ridge 44A and second ridge 44B may thus vary, by differing in value, and thus first ridge 44A and second ridge 44B may differ in shape. First ridge 44A and second ridge 44B may each have a radial height which varies along a dimension, such as width or depth, of first ridge 44A and second ridge 44B, respectively. For example, first ridge height 45A may differ in value at various positions along first ridge width 46A of first ridge 44A and second ridge height 45B may differ in value at various positions along second ridge width 46B of second ridge 44B. The height of a ridge, such as first ridge 44A and/or second ridge 44B, may therefore not be the same across a dimension, for example, the width or depth, of the ridge.

Similarly, first ridge depth 47A may differ in value at various positions along first ridge width 46A of first ridge 44A and second ridge depth 47B may differ in value at various positions along second ridge width 46B of second ridge 44B. The depth of a ridge may therefore not be the same across the width of the ridge.

The height, width, and depth dimensions of first ridge 44A and second ridge 44B may furthermore not be dependent on each other.

In some embodiments, first ridge height 45A and second ridge height 45B are greater than nominal thickness 34 of shroud body 30.

First ridge height 45A and second ridge height 45B may vary along their width as ridges 44A, 44B extend between fins 42A, 42B.

First ridge height 45A and second ridge height 45B may be shorter than height 41 of fins 42A, 42B but could have similar height.

In some embodiments, a maximum radial height (for example, parameter C as illustrated in FIGS. 3A, 3B) of second ridge 44B differs from a maximum radial height of first ridge 44A.

Segments of second ridge height 45B, in direction A3, may be defined by parameters B, C, and D, as illustrated in FIGS. 3A, 3B. First ridge height 45A may be defined by similar parameters (not shown).

Segments of nominal thickness 34 of shroud body 30 may be defined by parameters A and E, illustrated in FIGS. 3A, 3B, define a height of shroud body 30 outwardly from fins 42A, 42B.

Segments of first ridge width 46A, in direction A2, may be defined by parameters O, P, and Q, as illustrated in FIG. 3A.

Segments of second ridge width 46B, in direction A2, may be defined by parameters L, M and N, as illustrated in FIG. 3A.

Segments of first ridge depth 47A, in direction A1, may be defined by parameters I, J, and K, as illustrated in FIG. 3A.

Segments of second ridge depth 47B, in direction A1, may be defined by parameters F, G, and H, as illustrated in FIG. 3A.

Parameters of the dimensions of first ridge 44A and second ridge 44B, such as one or more of A, B, C, D, E, F, G, H, I, J, K, L, M, N, O, P, and Q as described herein may be varied, for example, with relation to each other, to achieve a desired overall blade (shroud, airfoil and platform) stress solution.

As shown in FIGS. 3A, 3B, height parameters B, C, D may be greater than nominal thickness 34 of shroud body 30 at outer side 31.

In some embodiments, at width positions of a ridge, such as one or more of height parameters B, C, D, height of the ridge may be equal to nominal thickness 34 of shroud body 30 at outer side 31. For example, as shown in the embodiment illustrated in FIG. 4, second ridge height 45B' may be equal at width positions indicated by height parameter A', differing at a width position indicated by height parameter B', thus forming a discontinuous ridge between fins 42A, 42B. Any parameter of height, width or depth may also differ.

First ridge height 45A and second ridge height 45B may transition between segment heights forming a convex surface, as shown in FIGS. 3A, 3B. Other suitable transitions are contemplated, for example, a concave surface or a straight surface at an angle between zero and a hundred and eighty degrees.

Therefore, height, width, and depth parameters of segments of first ridge 44A may vary. Height, width, and depth parameters of segments of second ridge 44B may also vary.

Any parameters of height, width and depth dimensions of segments of first ridge 44A and second ridge 44B may be the same or different.

Height, width, and depth parameters of segments of first ridge 44A and second ridge 44B may vary as between first ridge 44A and second ridge 44B.

In some embodiments, first ridge 44A and second ridge 44B are translationally symmetrical, for example, as shown in FIGS. 3A, 3B.

First ridge 44A and first side edge 38A define a first contact face 50A for abutment with a counterpart contact face of an adjacent turbine blade, in particular an adjacent shrouded blade. Similarly, second ridge 44B and second side edge 38B defined a second contact face 50B for abutment with a counterpart contact face of an adjacent turbine blade, in particular an adjacent shrouded blade.

First ridge 44A may provide an increased area to first contact face 50A, and second ridge 44B may provide an increased area to second contact face 50B, which in turn may reduce the contact stresses which arise from contact with mating bearing faces of adjacent turbine blades.

In some embodiments, the counterpart contact face, on an adjacent turbine blade, abutted by first contact face 50A has the same shape as second contact face 50B formed by second ridge 44B and second side edge 38B.

In some embodiments, the counterpart contact face abutted by second contact face 50B has the same shape as first contact face 50A formed by first ridge 44A and first side edge 38A.

First contact face 50A and second contact face 50B may be the same shape or different.

Parameters of first ridge height 45A and second ridge height 45B may be minimised in order to reduce weight and to reduce shroud 25 deflection.

Parameters of first ridge height 45A and second ridge height 45B may be selected to address shroud 25 interlock bearing stress and load requirements with respect to all adverse manufacturing tolerance effects.

First contact face 50A and second contact face 50B may be defined so as to provide an appropriate dynamic damping response and affect the structure stiffness behavior. The contact face area may be defined as the first ridge height 45A or second ridge height 45B times a length of the edge between the first contact face 50A or second contact face 50B and the outer face 31.

Figure 4:
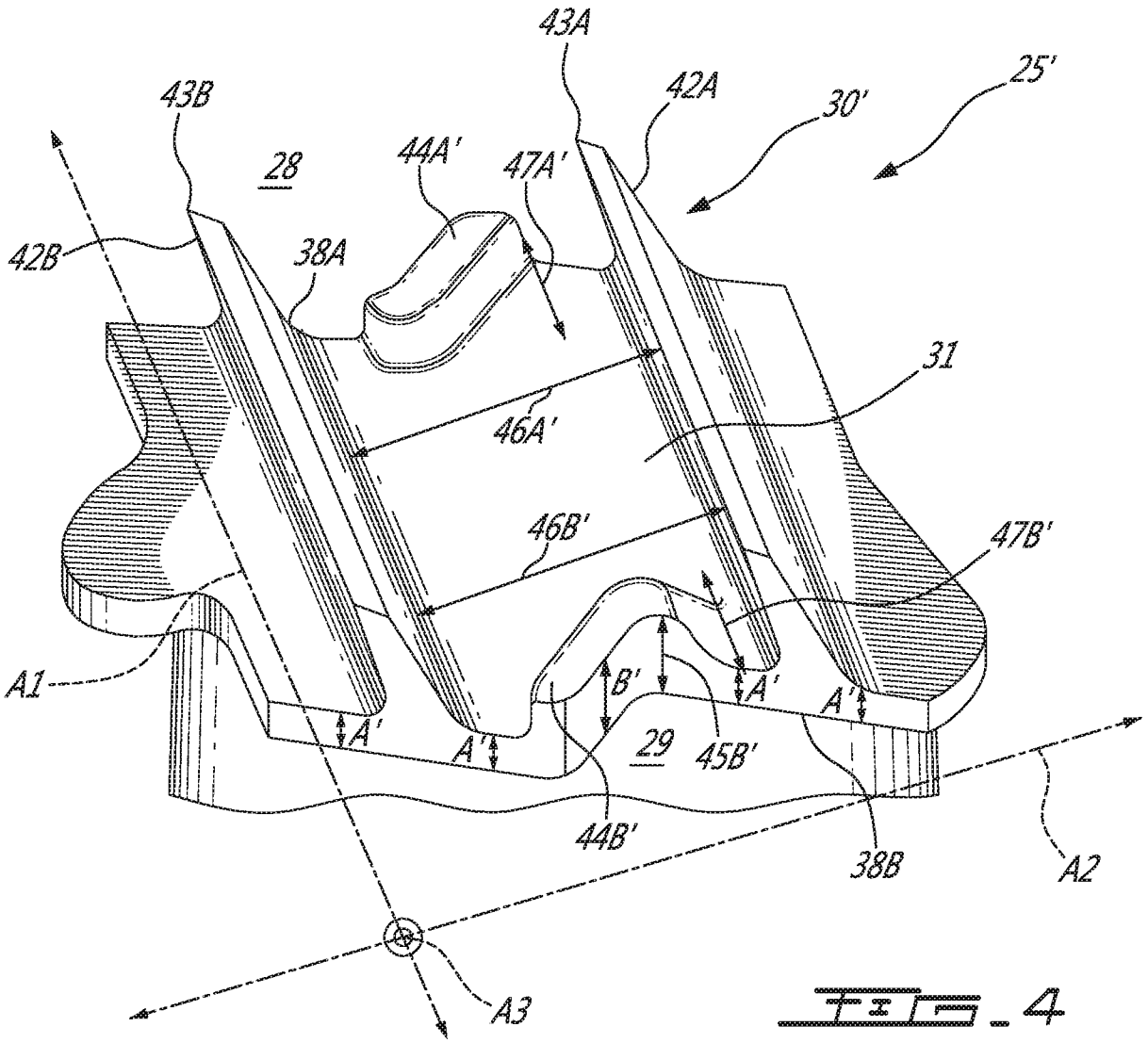
FIG. 4 is a perspective view of a shroud, according to another embodiment.

FIG. 4 is a perspective view of a shroud 25' having a shroud body 30'. Shroud 25' and shroud body 30' are generally similar in structure and components to shroud 25 and shroud body 30, differing in first ridge 44A and second ridge 44B replaced by first ridge 44A' and second ridge 44B'. For simplicity, features of shroud 25' which are similar to those of the shroud 25 have been labelled with the same reference numerals and will not be described again in detail.

As shown in FIG. 4, first ridge 44A' and second ridge 44B' may be generally elliptical prism in shape.

First ridge 44A' and second ridge 44B' may transition to outer face 31 forming a convex surface, as shown in FIG. 4. Other suitable transitions are contemplated, for example, a concave surface or a straight surface at an angle between zero and a hundred and eighty degrees.

First ridge 44A' and second ridge 44B' may have a first ridge height 45A' and second ridge height 45B', respectively, may vary between height parameters of B' and A', as shown in FIG. 4.

As illustrated in FIG. 4, segments of first ridge 44A' and second ridge 44B' may have a height (A) equal to a height (A) of shroud body 30 outwardly from fins 42A, 42B.

First ridge 44A' and second ridge 44B' may have a first width 46A' and a second width 46B', respectively, as shown in FIG. 4.

First ridge 44A' and second ridge 44B' may have a first depth 47A' and a second depth 47B', respectively, as shown in FIG. 4.

Parameters of segments of height, width or depth of ridges described herein may not be dependent on one another, and they may or may not have identical values or shapes. The parameters may varied to achieve an optimal overall blade (shroud, airfoil and platform) solution. Thus, shroud weight and stresses may be coordinated such that airfoil stresses can be optimized. This allows for distributing the mass of the shroud in stress critical locations, which may be achieved while minimizing effecting the airfoil stresses.

Conveniently, having a thinner structure of one or both of ridges 44A, 44B between the fins 42A, 42B may allow for minimising the bending stress and weight of shroud 25.

Independent parameterization of the height, width and depth of ridges 44A, 44B may allow for flexible material addition or removal.

Some embodiments of a shroud as described herein may allow for stress reduction in a shroud interlock area, effective shroud balancing to lower blade stresses, and maximum shroud weight reduction to lower blade stresses.

Parameters of ridges of a shroud may be selected so as to achieve a balance between stresses of increasing interlock area of contact faces and reducing the weight of the shroud at the distal end of the blade, hence reducing airfoil stresses.

The above description is meant to be exemplary only, and one skilled in the art will recognize that changes may be made to the embodiments described without departing from the scope disclosed. Although the shroud is shown herein to be used on blades of a turbofan gas turbine engine, it is contemplated that the shroud could be used on blades or rotor blades of other types of gas turbine engines, such as turboshaft, turboprop, or auxiliary power unit. Although the shroud may be cast with the rest of the turbine blade as a single element, it is contemplated that the local projections from the body portion of the shroud, such as the fins and the ridges, could be incorporated onto existing shrouded turbine blades, to reduce shroud contact face fretting and increase the contact face life. Existing cast shrouded turbine blades could include such edge projections, through a relatively minor casting tool change. Further, these edge projections can also be added as a post-production add-on or blade repair process, being added to the turbine shroud using methods which are known to one skilled-in the art, such as braze or weld material build-up or other method. Accordingly the above permits increases to the shroud contact face surface area to reduce contact stress between already-manufactured turbine shrouds. It is contemplated that the shroud could have more than two fins such as the fins described above. It is also contemplated that the shroud could have more than two ridges. Still other modifications which fall within the scope of the present invention will be apparent to those skilled in the art, in light of a review of this disclosure, and such modifications are intended to fall within the appended claims.

What is claimed is:

1. A turbine blade for a turbine engine, the turbine blade comprising:

an airfoil extending radially between a blade root and a blade tip; and a shroud provided at the blade tip of the airfoil, the shroud including:

a shroud body having a radial thickness and a radially outer side radially opposite the airfoil, the body having opposite first and second Z-shaped side edges;

a first sealing fin and a second sealing fin, the first and second sealing fins extending radially outwardly from the outer side of the shroud body and spaced apart from each other in a streamwise direction relative to a direction of flow of combustion gases through the turbine engine in use, the first and second sealing fins extending between the first and second side edges of the shroud body;

a first ridge extending radially outwardly from the outer side of the shroud body, the first ridge extending from and connecting the first sealing fin and the second sealing fin along an entirety of the first side edge, the first ridge having:

a first segment of the first ridge joined to the first sealing fin and joined with the shroud body to define a first ridge first radial height that is greater than the radial thickness of the shroud body, a second segment of the first ridge joined to the second sealing fin and joined with the shroud body to define a first ridge second radial height that is greater than the radial thickness of the shroud body, and a third segment of the first ridge joined to the first segment of the first ridge and the second segment of the first ridge and joined with the shroud body to define a first ridge third radial height that is greater than the radial thickness of the shroud body, the first ridge having a non-uniform radial height which varies along the first ridge between the first ridge first radial height, the first ridge second radial height and the first ridge third radial height; and a second ridge extending radially outwardly from the outer side of the shroud body, the second ridge extending from and connecting the first sealing fin and the second sealing fin along an entirety of the second side edge, the second ridge having:

a first segment of the second ridge joined to the first sealing fin and joined with the shroud body to define a second ridge first radial height that is greater than the radial thickness of the shroud body, a second segment of the second ridge joined to the second sealing fin and joined with the shroud body to define a second ridge second radial height that is greater than the radial thickness of the shroud body, and a third segment of the second ridge joined to the first segment of the second ridge and the second segment of the second ridge and joined with the shroud body to define a second ridge third radial height that is greater than the radial thickness of the shroud body, the second ridge having a non-uniform radial height which varies along the second ridge between the second ridge first radial height, the second ridge second radial height and the second ridge third radial height.

2. The turbine blade of claim 1, wherein a depth of the first ridge tangential to the outer side and parallel to the first sealing fin varies along a width of the first ridge tangential to the outer side and perpendicular to the first sealing fin.

3. The turbine blade of claim 1, wherein a depth of the second ridge tangential to the outer side and parallel to the first sealing fin varies along a width of the first ridge tangential to the outer side and perpendicular to the first sealing fin.

4. The turbine blade of claim 1, wherein the first ridge and the second ridge are translationally symmetrical.

5. The turbine blade of claim 1, wherein the first ridge differs in shape from the second ridge.

6. The turbine blade of claim 1, wherein a maximum radial height of the first ridge differs from a maximum radial height of the second ridge.

7. The turbine blade of claim 1, wherein the first ridge and the first side edge define a first contact face for abutment with a first counterpart contact face of a first adjacent turbine blade.

8. The turbine blade of claim 1, wherein the second ridge and the second side edge define a second contact face for abutment with a second counterpart contact face of a second adjacent turbine blade.

9. The turbine blade of claim 1, wherein the first ridge third radial height is greater than the first ridge first radial height and the first ridge second radial height.

10. The turbine blade of claim 1, wherein the first ridge first radial height is constant over a distance of the first segment of the first ridge perpendicular to the first sealing fin, the first ridge second radial height is constant over a distance of the second segment of the first ridge perpendicular to the first sealing fin, and the first ridge third radial height is constant over a distance of the third segment of the first ridge perpendicular to the first sealing fin.

11. The turbine blade of claim 1, wherein the third segment of the first ridge joins the first segment of the first ridge at a first rounded transition, and the third segment of the first ridge joins the second segment of the first ridge at a second rounded transition.

12. A shroud for a rotor blade, the shroud comprising:

a shroud body having a radial thickness, an outer side and opposite first and second Z-shaped side edges;

a first sealing fin and a second sealing fin extending radially outwardly from the outer side and being spaced apart from each other in a streamwise direction relative to a direction of flow of combustion gases through the rotor blade in use, the first and second sealing fins extending between the first and second side edges of the shroud body;

a first ridge extending radially outwardly from the outer side of the shroud body, the first ridge extending from and connecting the first sealing fin and the second sealing fin along an entirety of the first side edge, the first ridge having:

a first segment of the first ridge joined to the first sealing fin and joined with the shroud body to define a first ridge first radial height that is greater than the radial thickness of the shroud body, a second segment of the first ridge joined to the second sealing find and joined with the shroud body to define a first ridge second radial height that is greater than the radial thickness of the shroud body, and a third segment of the first ridge joined to the first segment of the first ridge and the second segment of the first ridge and joined with the shroud body to define a first ridge third radial height that is greater than the radial thickness of the shroud body, the first ridge having a non-uniform radial height which varies along the first ridge between the first ridge first radial height, the first ridge second radial height and the first ridge third radial height; and a second ridge extending radially outwardly from the outer side of the shroud body, the second ridge extending from and connecting the first sealing fin and the second sealing fin along an entirety of the second side edge, the second ridge having:

a first segment of the second ridge joined to the first sealing fin and joined with the shroud body to define a second ridge first radial height that is greater than the radial thickness of the shroud body, a second segment of the second ridge joined to the second sealing fin and joined with the shroud body to define a second ridge second radial height that is greater than the radial thickness of the shroud body, and a third segment of the second ridge joined to the first segment of the second ridge and the second segment of the second ridge and joined with the shroud body to define a second ridge third radial height that is greater than the radial thickness of the shroud body, the second ridge having a non-uniform radial height which varies along the first ridge between the second ridge first radial height, the second ridge second radial height and the second ridge third radial height.

13. The shroud of claim 12, wherein a depth of the first ridge tangential to the outer side, and parallel to the first sealing fin varies along a width of the first ridge perpendicular to the first sealing fin.

14. The shroud of claim 12, wherein the first ridge and the second ridge are translationally symmetrical.

15. The shroud of claim 12, wherein the first ridge differs in shape from the second ridge.

16. The shroud of claim 12, wherein a maximum radial height of the first ridge differs from a maximum radial height of the second ridge.

17. The shroud of claim 12, wherein the first ridge third radial height is greater than the first ridge first radial height and the first ridge second radial height.

18. The shroud of claim 12, wherein the first ridge first radial height is constant over a distance of the first segment of the first ridge perpendicular to the first sealing fin, the first ridge second radial height is constant over a distance of the second segment of the first ridge perpendicular to the first sealing fin, and the first ridge third radial height is constant over a distance of the third segment of the first ridge perpendicular to the first sealing fin.

19. The shroud of claim 12, wherein the third segment of the first ridge joins the first segment of the first ridge at a first rounded transition, and the third segment of the first ridge joins the second segment of the first ridge at a second rounded transition.

* * * * *